United States Patent [19]

Beckham

[11] 4,207,987

[45] Jun. 17, 1980

[54] APPARATUS AND METHOD FOR SPIRAL SEPARATION OF MATERIALS

[75] Inventor: L. S. Beckham, West Lafayette, Ind.

[73] Assignee: Ag Machinery & Safety, Inc., West Lafayette, Ind.

[21] Appl. No.: 885,213

[22] Filed: Mar. 10, 1978

[51] Int. Cl.[2] ..... B07C 9/00

[52] U.S. Cl. ..... 209/691; 209/697

[58] Field of Search ..... 209/691, 694, 696, 697

[56] References Cited

U.S. PATENT DOCUMENTS

| | | | |
|---|---|---|---|
| 815,856 | 3/1906 | Nichter | 209/691 |
| 1,542,155 | 6/1925 | Lyman | 209/697 |
| 2,724,498 | 11/1955 | Beresford | 209/697 |
| 3,421,618 | 1/1969 | Burney et al. | 209/696 X |

*Primary Examiner*—Joseph J. Rolla

*Attorney, Agent, or Firm*—John R. Nesbitt

[57] ABSTRACT

An apparatus and method are disclosed for spiral separation of materials. The apparatus includes spiral separator flights mounted on a vertical tube within an enclosure with the material, such as seeds, to be separated being introduced into the apparatus through the vertical tube upon which the spirals are mounted. One of the separated material fractions is discharged from the apparatus through the vertical tube while the other fraction is discharged from a second discharge outlet. A spiral driving mechanism and a baffle are provided for separator adjustability and a plurality of spirals may be enclosed within a common housing. The method includes separating materials by introducing the materials onto spirals at a separating area, controlling the speed of rotation of the spirals to control separation, and collection the separated fractions.

25 Claims, 6 Drawing Figures

APPARATUS AND METHOD FOR SPIRAL SEPARATION OF MATERIALS

BACKGROUND OF THE INVENTION

The need for separation of materials has long been recognized in many diverse fields, including processing of materials such as coal or grain, for example. One of the more commonly utilized devices heretofore developed for processing of such materials is the spiral separator.

The spiral separator is a machine used to process substances containing fractions which differ in shape and/or sliding resistance, and have, therefore, been found to be particularly useful in fields such as coal processing and seed or grain processing.

The spiral separator normally consists of one or more flights spirally wound around a central vertical axis. The substances to be processed are discharged onto the upper end of these flights. Fractions which are round or have differentially less sliding resistance travel at a faster rate then flat fractions or those with greater sliding resistance. As momentum increases, the round fraction, or that fraction with less sliding resistance, rolls off the edge of the spiral flight and is therefore separated since the flat fraction, or the fraction with greater sliding resistance, fails to achieve sufficient momentum to roll or slide off the edge of the spiral flights.

Spiral separators and/or basic operation of such separators are shown, by way of example, in U.S. Pat. Nos. 694,420; 964,444; 1,069,517; 1,507,890; and 1,959,736.

While spiral separators have been heretofore developed and used, such systems have not been completely successful and further improvements have been needed. In my copending U.S. application, Ser. No. 736,257, filed Oct. 27, 1976, and entitled "Adjustable Unit for Spiral Separators," now U.S. Pat. No. 4,146,137, issued Mar. 27, 1979 I have set forth one such improvement for a spiral separator wherein an attachment is added to enhance separator operation.

Spiral seed separators now known and utilized have still other disadvantages including, for example, a capacity limitation arising from the number of individual spirals that can be utilized due to the manner of introducing material to be separated into the device at the upper flights and the manner of discharging the fractions from the device after separation, the difficulty or complete absence of spiral adjustment needed to achieve better and more precise separation, and excessive noise problems.

SUMMARY OF THE INVENTION

This invention provides an improved spiral separator device and method that enables spiral adjustment, increases the capacity by providing a novel material introduction and discharge, and reduces noise problems. A central tube feed is provided with the spirals being mounted on the central tube within a housing, and discharge of one fraction is through the central tube. Adjustability is provided by controlling the speed of rotation of the spirals with a baffle also being provided to enhance adjustability.

It is therefore an object of this invention to provide an improved apparatus and method for separating materials.

It is another object of this invention to provide an improved apparatus and method for separating materials that include spiral separation.

It is still another object of this invention to provide an improved apparatus and method that enables spiral adjustment, increases the capacity of the device, and reduces noise.

It is yet another object of this invention to provide an improved apparatus and method for separating materials that includes a central material feed for introduction of material to the system.

It is still another object of this invention to provide an improved apparatus and method for separating materials that utilizes a central tube having spirals mounted thereon for introduction of material to be separated and discharge of one fraction after separation has occurred.

It is yet another object of this invention to provide an improved apparatus for separating materials that includes rotatively driving spirals mounted on a central shaft through which materials to be separated are introduces into device.

It is still another object of this invention to provide a separating apparatus having a sliding baffle to enhance separation.

It is yet another object of this invention to provide an improved spiral separator device having one or more spiral flights enclosed within a common housing.

It is still another object of this invention to provide an improved method for separating materials wherein material is introduced onto spirals and speeds of rotation of the spirals is controlled to control separation of materials.

With these and other objects in view, which shall become apparent to one skilled in the art as the description proceeds, this invention resides in the novel construction, combination, and arrangement of parts substantially as hereinafter described, and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best modes so far devised for the practical application of the principals thereof, and in which.

DESCRIPTION OF THE INVENTION

Figure 1:
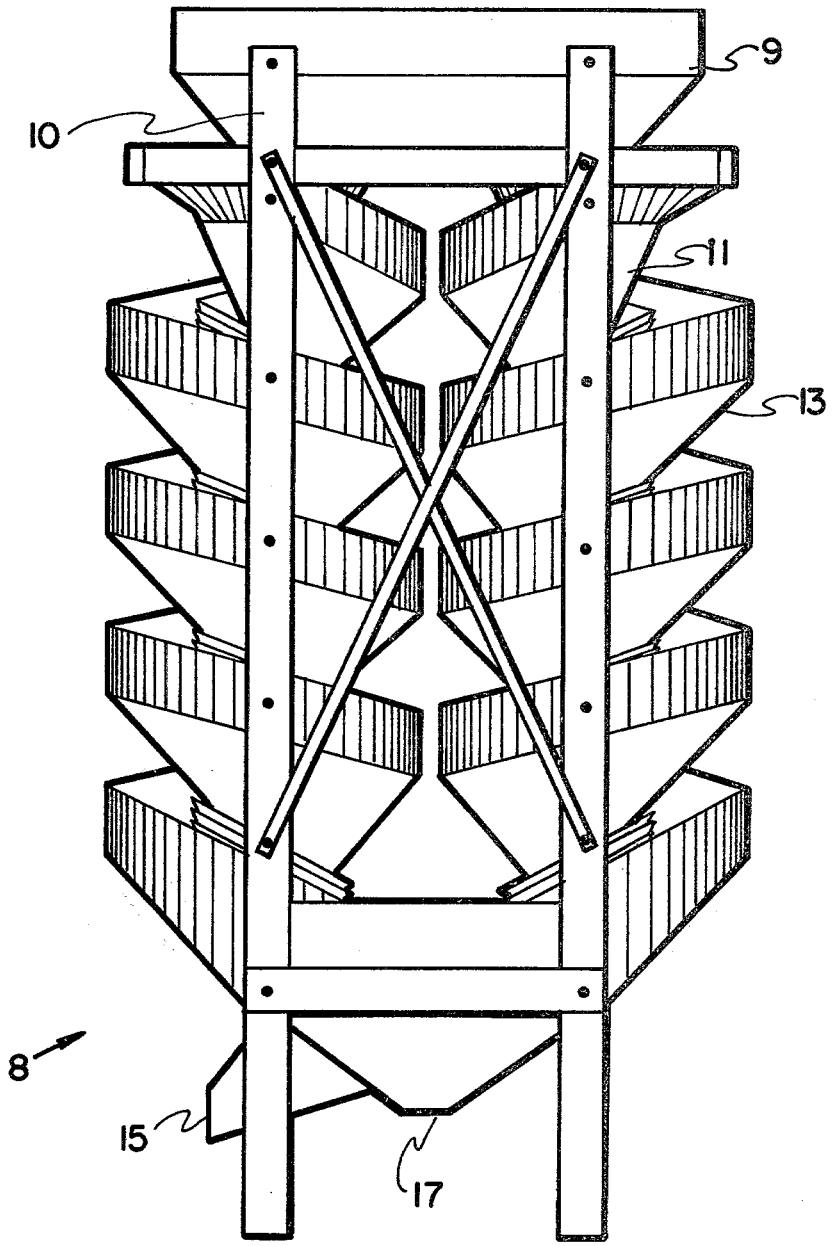
FIG. 1 PRIOR ART
FIG. 1 is a typical spiral separator known in the prior art.

Spiral separators are well known in the prior art (see, for example, the patents referred to hereinabove), and a typical spiral separator 8 is shown in FIG. 1. As shown, the material to be separated (such as seed) is commonly introduced through hopper 9 mounted on frame 10 and fed to the inner flights 11 below the hopper. The fraction which flies off the inner flights during descent of the material to be separated is received by the outer flight 13 which directs it to discharge outlet 15 (such as, for example, a clean seed outlet where seed is being separated and cleaned). The fraction which remains on the inner flights during descent discharges at a second discharge outlet 17.

The method of feeding and removing the two fractions from a separator as shown in FIG. 1 places limitations on its use. First, only two spirals may be combined together in one machine. Second, adjustments to the spirals themselves are limited. Third, since the two units are physically attached to each other, they cannot be rotated or turned individually.

This invention provides an improved spiral separator 19 that includes:

inlet means 20 for feeding the material to be processed into the top of a vertical tube 22 onto a cone 24 within the tube and then through a plurality of slots 26 which correspond to the number of flights 28 spirally wound around the tube (the incoming product is about equally divided by the cone, which is recessed within the tube, before going through the slots);

a vertical slot 32 in the vertical tube 22 at the lower of the spirals which discharges the fraction left on the spirals back into the vertical tube (the lower end of the spirals are closed to assure that all product left on the spirals is discharged through the slot back into the vertical tube);

a housing 34 around one or more spiral separator arrangements to enclose the same (the housing decreases noise from the spiral separator, if the bottom of the housing is hoppered, as at 36, the fraction discharging off the spirals can be caught within the housing and the fraction from the plurality of spirals to be discharged at a single outlet 38, if the mounting system for the individual spiral separators within the housing is fashioned to recombine the product fraction left on the spirals and discharged back within the tube this can be combined and discharged from the housing at a single outlet 40, and if an air system is attached to the housing dust or other atmosphere contaminating products which may result from the fractionating action of the spirals can be removed);

a driving mechanism 42 for revolving the entire spiral consisting of a vertical tube with a plurality of spirally wound flights thereon (such rotation is possible because of the internal feeding of the product onto the flights from within the tube, the subsequent internal discharge of the fraction remaining on the spiral flights back inside the tube, and the use of a housing to contain the spiral units) (revolving the tube upon which the spiral flights are vertically wound when combined with a variable speed drive allows an infinite adjustment of speed at which the spiral unit can be rotated, and by changing the r.p.m at which the unit is revolved the centrifugal forces acting upon the substance to be processed as it proceeds down the flighting changes, and this combined with the differential physical properties of the fractions of the substance to be separated allows for a precise separation of the two fractions with the fraction which is discharged from the spiral flighting being removed faster as the r.p.m. increases); and a sliding baffle plate 44 at the bottom of the spirals where the spirals terminate into the cull discharge (if the product to be separated is not perfectly differentiated from the remainder of the product, a fraction will remain on the spiral and the sliding baffle plate allows the fraction to be separated which remains on the spiral to be selectively removed from the spiral—for example, certain soybean varieties tend to have flattened seed, and when this occurs, a fraction of the good seed will not roll off the spiral and would be cleaned out except that the sliding baffle plate is adjusted so as to allow the fraction of good seed to roll off the spiral).

Figure 2:
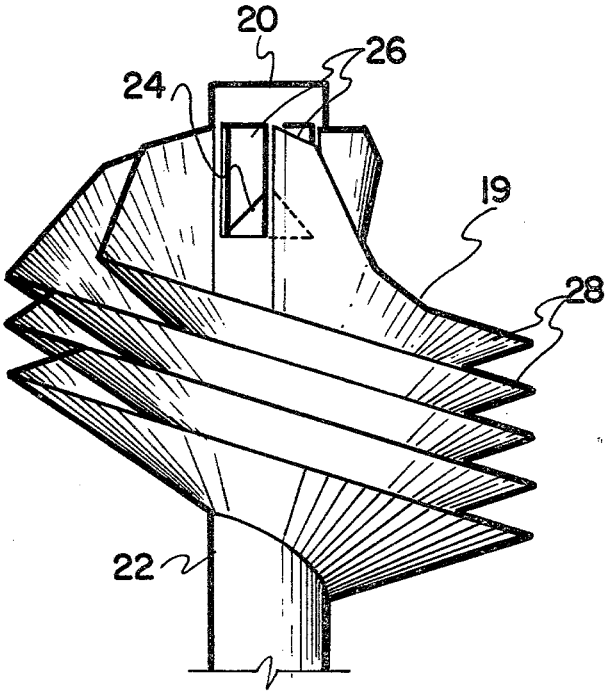
FIG. 2 is a side view of the top portion of the spiral separator of this invention illustrating material feed through the vertical tube.

FIG. 2 illustrates the top portion of the vertical central tube 22. As shown, the spirally wound flights 28 are mounted on vertical tube 22. The material, or product, is introduced through the inlet 20 at the top of the tube 22. It is then divided by the cone 24 and from the cone, the product goes through the slots 26. There is one slot for each flight. After the product goes through the slots, it discharges onto the flights 28. The flights 28 are attached to the tube 22 in a vertical position to reduce spillage and properly guide the product.

Figure 3:
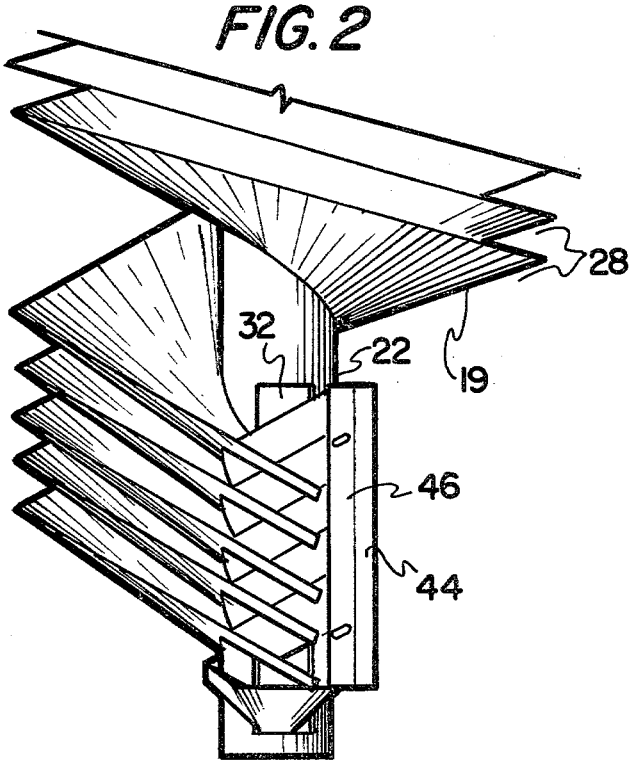
FIG. 3 is a side view of the lower portion of the spiral separator of this invention illustrating the discharge of one fraction back into the vertical tube.

FIG. 3 illustrates the bottom portion of the tube 22 with the vertical slot 32 therein. The flights 28 are terminated into an end plate 46. This forces the product left on the flights 28 into the vertical slot 32. The end plate 46 is attached to the tube 22 and to the flights 28.

Figure 4:
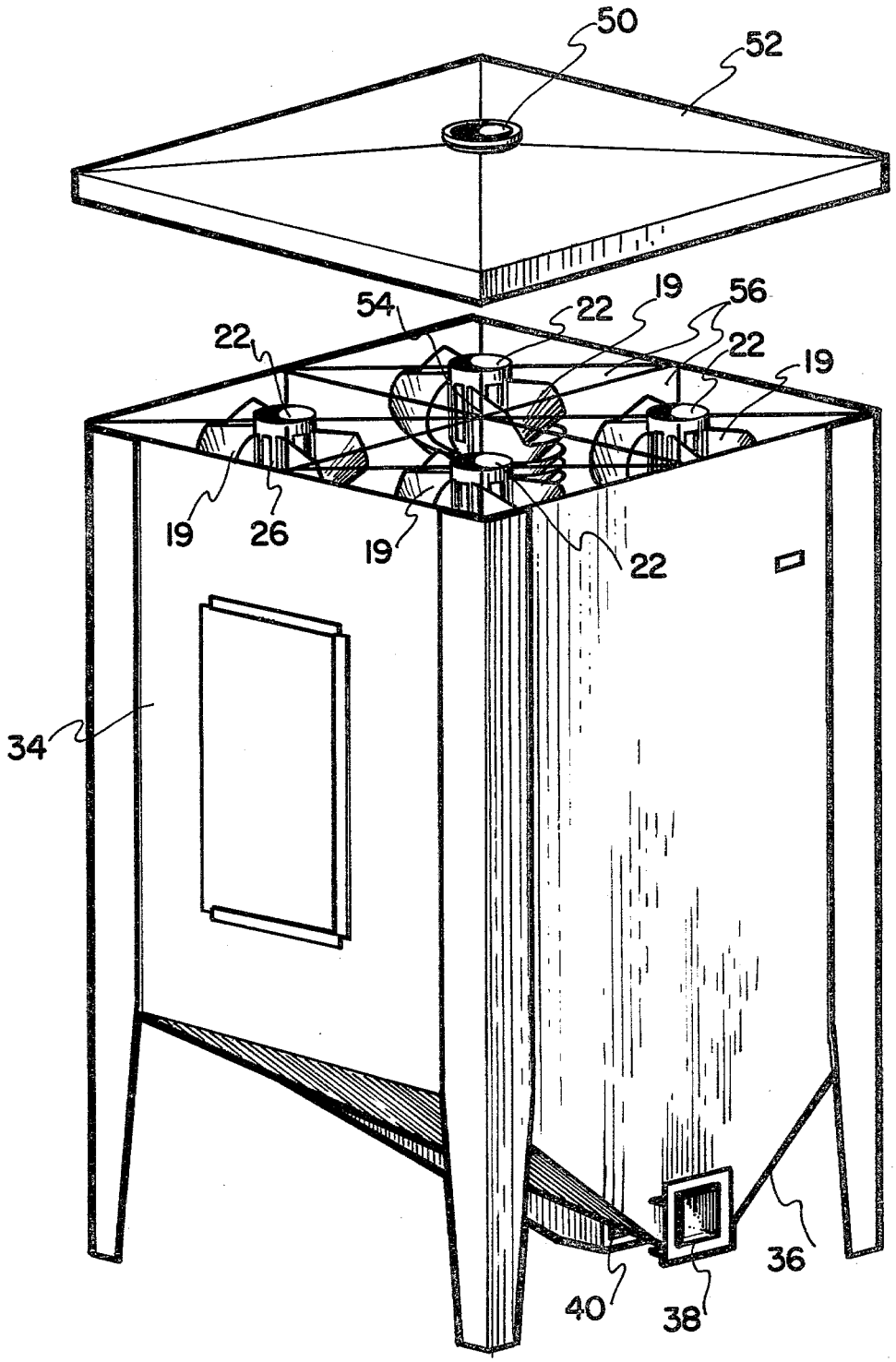
FIG. 4 is a perspective view illustrating a plurality of spirals enclosed within a common housing.

FIG. 4 illustrates a housing 34 containing four inner spiral arrangements 19. The product to be separated is introduced through central aperture 50 in the top cover 52 of the housing. It impacts on the central corner 54 of the four top hoppers 56. The seed divides approximately evenly into the top hoppers and goes into the spiral inlets 20. From inlets 20, the product enters into the top of the tube 22 (as shown in FIG. 2). The fraction of the product which discharges from the flights 28 falls into the housing 34. The fraction which remains on the spiral flights discharges back into the tube (as shown in FIG. 3). The product in the housing 34 discharges through the opening 38, while the fraction which discharges back into the tube 22 is combined with similar fractions from other tubes and discharges from the housing at outlet 40.

Figure 5:
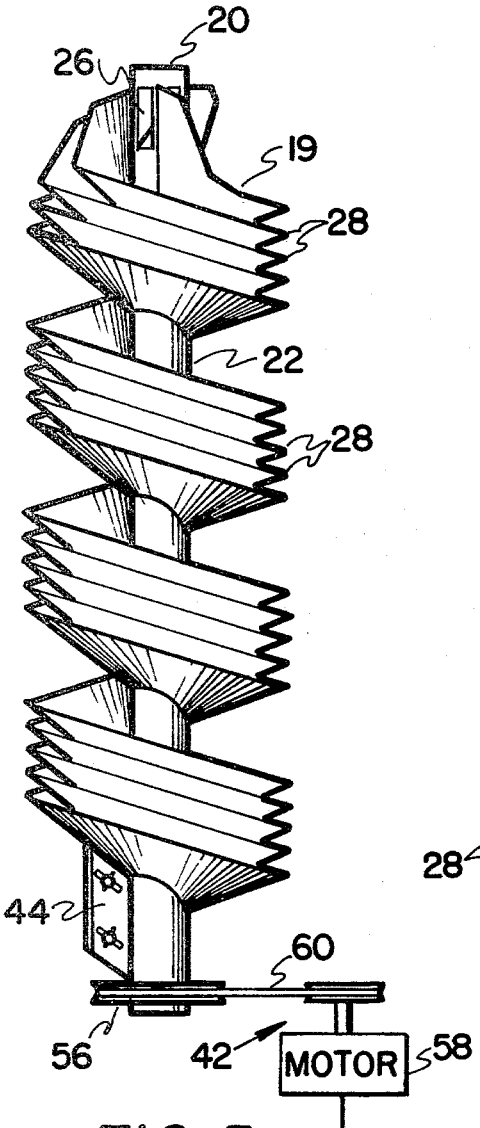
FIG. 5 is a side view of a spiral separator having a drive pulley thereon for rotation of the separator.

FIG. 5 illustrates the rotation of each spiral separator. The spiral is preferably rotated in a horizontal plane around a vertical axis by means of pulley 56 driven by motor 58 through belt 60. Motor 58 is controlled by conventional speed control unit 62 to vary the speed of rotation of the separator as desired. The centrifugal force exerted on the product on the flights 28 would either increase or decrease depending upon the speed of rotation of the flights. Since the fractions to be separated differ in either shape or sliding resistance, or both, the change in force accents the difference in separation achieved between the two fractions. The spiral could be conventionally rotated by drive belts, gears or chains through a sheave or gear attached to the top or bottom of the tube, and bearing surfaces facilitate turning.

Figure 6:
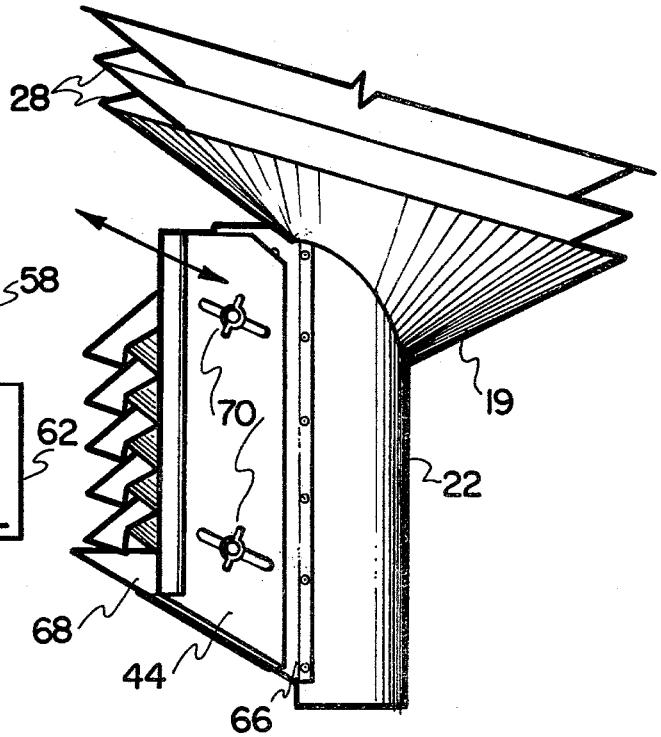
FIG. 6 is a side view of the lower portion of the spiral separator illustrating a sliding baffle plate thereat.

FIG. 6 best illustrates the sliding baffle plate 44, the action of the plate and the modification of the spirals. A stationary plate 66 is attached to the tube 22 into which the spirals 28 terminate. The plate has an extension 68 at the bottom which cups around the bottom-most spiral and extends into the slot 32 in the tube. The spirals themselves are modified so that the upper portion of the spiral (that side away from the tube) does not terminate into the stationary baffle plate but continues at the same continuous curve.

The sliding baffle plate 44 is attached to the stationary plate 66 by wing nut 70 or other easily loosened fasteners. When the sliding baffle plate is fastened in a position close to the tube, product remaining on the high side of the spiral discharges from the spiral and not into the slot 32. Product on the lower side of the spiral always discharges into the slot 32. When the sliding baffle plate is fastened in a position full away from the tube, all the product remaining on the spiral discharges into the slot 32. An infinite number of intermediate positions allow the operator to selectively remove or keep a wide range of product fraction.

In operation, the spiral separator is continuously rotated while material, such as seed to be cleaned and separated, is introduced into the spiral separator at the inlet at the top of the separator. The material is directed to the rotating spirals where the fraction with the least frictional resistance is thrown off the spiral due to centrifugal force with the other fraction being retained on the spirals. The speed of rotation is selected, of course, to produce the most effective separation of the processed material. Separated fractions are then discharged and collected. An additional adjustment is provided by adjustment of the baffle plate at the bottom of the separator.

From the foregoing, it can be appreciated that this invention provides an improved apparatus and method for separating materials utilizing a spiral arrangement.

What is claimed is:

1. A spiral separator device, comprising:

an inlet for receiving material to be separated;

a plurality of spiral flights for separating material thereon into separate fractions;

a mounting tube having said spiral flights mounted thereon, said mounting tube including directing means within said tube for receiving material to be separated from said inlet and directing the same in substantially equal amounts to each of said spiral flights; and first and second discharge outlets for discharing different ones of said fractions separated at said spiral flights.

2. The spiral separator device of claim 1 wherein said inlet opens into the top of said mounting tube, and wherein said mounting tube has an outlet above and adjacent to each of said spiral flights with each said outlet having material to be separated directed thereto by said directing means.

3. The spiral separator device of claim 1 wherein said device includes baffle means adjacent to said discharge outlets to facilitate separation of materials by said device, said baffle means being slidable to enable selective adjustment thereof for differentiation between selected fractions.

4. The spiral separator device of claim 1 wherein said directing means within said mounting tube is a concentric cone mounted therein to facilitate directing material substantially equally to each of said plurality of spiral flights.

5. The spiral separator device of claim 1 wherein said mounting tube has one of said discharge outlets therein for discharging one of said fractions separated by all of said spiral flights.

6. The spiral separator device of claim 5 wherein said mounting tube has openings therein for receiving material remaining on each of said spiral flights after separation with said received material being discharged from said first discharge outlet at the bottom of said mounting tube.

7. The spiral separator device of claim 6 wherein said second discharge outlet receives material that falls from said spiral flights during separation to discharge the same separately from the fraction received within said mounting tube and discharged through said first discharge outlet at the bottom of said mounting tube.

8. The spiral separator device of claim 6 wherein said device includes a slidable baffle adjacent to said opening in said mounting tube to facilitate separation of materials.

9. The spiral separator device of claim 7 wherein said device includes a housing surrounding said mounting tube and spiral flights so that said first discharge outlet discharges the fraction to be discarded from said housing through said mounting tube.

10. The spiral separator device of claim 9 wherein said inlet opens from the top of said housing into the top of said mounting tube, and wherein said first and second discharge outlets are located at the bottom of said housing for separately discharging separated material from the device.

11. The spiral separator device of claim 1 wherein said device includes means for rotating said mounting tube and said spiral flights.

12. The spiral separator device of claim 11 wherein said rotating means includes a motor for rotatively driving said mounting tube and spiral flights.

13. The spiral separator device of claim 12 wherein said rotating means includes speed control means for adjusting the speed of said motor and hence the speed of rotation of said spiral flights.

14. A spiral separator device, comprising:

an enclosed housing having an inlet for receiving matter to be separated and a pair of outlets for discharging separated material;

hollow mounting means within said housing, said hollow mounting means being a tube the top of which is in communication with said material inlet and the lower end of which communicates with one of said outlets in said housing whereby one of said separated fractions is discharged through said hollow mounting means, said tube having a plurality of ports therein; and a plurality of spiral flights mounted on said mounting means within said housing for receiving material received at said inlet of said housing, each of said spiral flights being mounted on said mounting means below different ones of said plurality of ports whereby said ports discharge the material to be separated substantially equally onto said spiral flights for separation of such material into different fractions, one of said fractions on each of said spirals being diverted into said hollow mounting means with said fractions then being separately discharged from said device at said pair of outlets.

15. The spiral separator device of claim 14 wherein said housing includes a removable top having said material inlet therein communicating with the other end of said hollow mounting means when said top is in the assembled position.

16. The spiral separator device of claim 14 wherein the bottom of said tube is in communication with one of said housing outlets to discharge discardable separated material from said housing therethrough, and wherein said tube has openings for receiving discardable material remaining on each of said spiral flights.

17. The spiral separator device of claim 14 wherein said device includes a plurality of spiral flights mounted on a plurality of mounting means all of which are positioned within said housing for receiving material from said inlet and supplying separated material to said outlets.

18. The spiral separator device of claim 17 wherein said inlet in said housing supplies material to be separated substantially equally to each of said spiral flights within said housing.

19. A spiral separator device, comprising:

an enclosed housing having an inlet for receiving material to be separated and a pair of outlets for discharging separated material;

a plurality of hollow mounting means within said housing, each of said hollow mounting means including a mounting tube the top of each of which is in communication with said housing inlet, each of said tubes having ports therein for discharging material substantially equally therefrom and the lower end of which communicates with one of said outlets in said housing whereby one of said separated fractions is discharged through said hollow mounting means; and a plurality of spiral flights mounted on said plurality of mounting means within said housing for substantially equally receiving material through said ports of said mounting means and separating such material into different fractions, one of said fractions on each of said spirals being diverted into said hollow mounting means with said fractions then being separately discharged from said device at said pair of outlets.

20. The spiral separator device of claim 19 wherein each of said mounting tubes has an opening in the bottom portion for receiving material remaining on each of said spiral flights mounted thereon, said material being discharged from the bottom of said mounting tubes to one of said outlets in said housing, said other outlet in said housing separately receiving the material expelled from said spiral flights during separation.

21. A spiral separator device, comprising:

a housing having an inlet for receiving material to be separated and a pair of outlets for separately discharging separated material;

a plurality of spiral flights within said housing for separating said material thereon into separate fractions;

a mounting tube within said housing having said spiral flights mounted thereon, said mounting tube receiving said material from said inlet at the top, thereof, and said mounting tube having a cone therein adjacent to ports on the sides of the top portion of said tube equal in number to the number of spiral flights mounted thereon and through which ports material received at the top of said mounting tube is substantially equally directed to said spiral flights, said mounting tube also having an opening on the side at the bottom portion for receiving material remaining on the spiral flights after separation and discharging the same to one of said outlets in said housing;

a baffle positioned adjacent to said opening on the side of the bottom portion of said mounting tube to facilitate material separation; and drive means for rotating said mounting tube and spiral flights mounted thereon.

22. The spiral separator device of claim 21 wherein said device includes a plurality of spiral flights mounted on a plurality of mounting tubes within said housing, and wherein said device includes means for directing material received at said housing inlet to the top of each of said mounting tubes for substantially equal distribution to each of said spiral flights.

23. A method for separating materials, said method comprising:

receiving materials to be separated and discharging the materials through a hollow tube substantially equally onto a plurality of spiral flights mounted on said tube for separation thereat;

rotating said spiral flights to separate the materials thereon into first and second fractions determined by whether the material remains on the flights during rotation; and separately collecting the fractions remaining on the flights and the fraction expelled from the flights.

24. The method of claim 23 wherein said method includes controlling the speed of rotation of said spiral flights for precise separation into said fractions.

25. The method of claim 23 wherein said method includes introducing the materials to be separated into a closed housing for separation while therein with discharge of at least discardable material being effected through said hollow tube.

* * * * *